US006255571B1

(12) United States Patent
Takahashi

(10) Patent No.: US 6,255,571 B1
(45) Date of Patent: Jul. 3, 2001

(54) TROMBONE STABLE IN TONE COLOR AND PITCH AND COMPACT VALVE USED THEREIN

(75) Inventor: Yoshihiro Takahashi, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/532,135

(22) Filed: Mar. 21, 2000

(30) Foreign Application Priority Data

Mar. 24, 1999 (JP) ..... 11-079487

(51) Int. Cl.[7] ..... G10D 7/10

(52) U.S. Cl. ..... 84/388; 84/389; 84/390; 84/395; 84/396

(58) Field of Search ..... 84/395, 396, 388, 84/389, 390, 393, 394

(56) References Cited

U.S. PATENT DOCUMENTS 1,035,482 * 8/1912 Schuster ..... 84/394
4,095,504 6/1978 Hirsbrunner ..... 84/390
4,469,002 * 9/1984 Thayer ..... 84/390
5,900,563 * 5/1999 Leonard ..... 84/390

FOREIGN PATENT DOCUMENTS 62-67590 3/1987 (JP) .
2-211498 8/1990 (JP) .

* cited by examiner

*Primary Examiner*—Shih-Yung Hsieh
(74) *Attorney, Agent, or Firm*—Ostrolenk, Faber, Gerb & Soffen, LLP

(57) ABSTRACT

A trombone has a rotary valve unit inserted between two parts of a main tube and further connected to a bypass tube, and a player manipulates the rotary valve unit for changing the length of vibrating air column, wherein the rotary valve unit has a cylindrical casing connected at both end surfaces thereof to the parts of the main tube, a first pair of ports formed on the side surface thereof and connected to both ends of the bypass tube and a second pair of ports, a short tube connected between the ports of the second pair and a rotor rotatable inside the cylindrical casing and having two air passages spaced from one another in the direction of the rotational axis thereof and connecting one of the parts of the main tube through the short tube to the other part at a first angular position and one of the parts through the bypass tube to the other part so that the rotary valve unit is compact.

13 Claims, 8 Drawing Sheets

TROMBONE STABLE IN TONE COLOR AND PITCH AND COMPACT VALVE USED THEREIN

FIELD OF THE INVENTION

This invention relates to a brass instrument and, more particularly, to a trombone and a valve used therein.

DESCRIPTION OF THE RELATED ART

A trombone is broken down into a mouthpiece, a main tube and a bell. The main tube contains a slide tube. The player puts the trombone on his left shoulder, and brows through the mouthpiece. The column of air vibrates so as to generate tones. The player slides the slide tube. Then, the trombone varies the effective length of the slide tube and, accordingly, the column of air, and changes the harmonic series.

A bypass tube is incorporated in a kind of trombone, and is connected to the slide tube by means of a valve. The bypass tube is branched from a portion of the slide tube, and returns to the slide tube at another portion. When the player manipulates the valve, the valve increases the effective length of the column of air, and changes the range of note.

FIG. 1 illustrates a typical example of the trombone. The prior art trombone comprises a mouthpiece (not shown), a main tube 1, a bypass tube 2 and a bell 3. The main tube includes an inner tube 4 and an outer tube 5. The inner tube 4 is inserted into the outer tube 5, and slidably supports the outer tube 5. When most of the outer tube 5 is overlapped with the inner tube 4, the column of air is relatively short. If a player projects the outer tube 5 from the inner tube 4, the outer tube 5 prolongs the column of air, and the prior art trombone changes the harmonic series.

The bypass tube 2 is connected to the main tube 1 by means of a rotary valve 6. The rotary valve 6 has four ports 7, 8, 9 and 10. The ports 7 and 8 are connected to the main tube 1, and the other ports 9 and 10 are connected to the bypass tube 2. When the rotary valve 6 connects the port 7 to the port 8, the ports 9 and 10 are disconnected from the ports 6 and 7, and the column of air extends from the inner tube 4 through the rotary valve 6 to the bell 3. The bypass tube 2 does not form any part of the column of air. If the player manipulates the rotary valve 6, the rotary valve 6 connects the ports 7 and 8 to the ports 9 and 10, respectively, and the column of air extends through the bypass tube 2. As a result, the column of air is prolonged.

The rotary valve 6 is disclosed in U.S. Pat. No. 4,095,504, and is shown in FIGS. 2 and 3 in detail. The rotary valve 6 largely comprises a casing 11 and a rotor 12. The four ports 7/8/9/10 are formed in the casing 11, and a column-shaped inner space is defined in the casing. The ports 7 and 8 are directed at 90 degrees from the other ports 9 and 10. The port 9 is directed at 180 degrees from the port 10, and the port 7 is aligned with the port 8.

The rotor 12 is accommodated in the casing 11, and occupies the column-shaped inner space. The rotor 12 has a shaft 13 and a core 15 assembled together, and the shaft 13 has a short projection 13*a* and a long projection 13*b*. The center axes of these projections 13*a*/13*b* are aligned with the axis of the core 15, and the projections 13/14 are rotatably supported by the casing 11. The long projection 13*b* extends through the casing 11.

Recesses 16/17 are formed in the core 15, and a cylindrical seal member 18 is inserted between the inner surface of the casing 11 and the core 15. The cylindrical seal member 18 does not permit the air to flow through the gap between the inner surface of the casing 11 and the core 15. For this reason, the air is allowed to flow only through the recesses 16/17 inside the casing 11. The recesses 16/17 are generally sectoral in cross section as shown in FIG. 2, and the bottom surfaces are gently curved. The recesses 16/17 are positioned in such a manner as to be aligned with the ports 7 to 10.

The core 15 is fixed to the shaft 13 by means of bolts 19, and a lever (not shown) is connected to the long projection 13*b*. When a player pushes the lever, the rotor 12, i.e., the shaft 13 and the core 15 turn in the column-shaped inner space together, and the core 15 changes the location of the recesses 16/17. When the rotor 12 is in the position shown in FIG. 2, the ports 7 and 8 are connected through the recesses 16/17 to the other ports 9 and 10, respectively, and the bypass tube 2 prolongs the column of air. On the other hand, if the rotor 12 turns at 90 degrees, the ports 7 and 9 are connected through the recesses 16 and 17 to the other ports 8 and 10, respectively, and the bypass tube 2 is disconnected from the main tube 1.

A problem is encountered in the trombone equipped with the prior art rotary valve shown in FIGS. 2 and 3 in that the player feels the tone color and the intervals unstable when the bypass tube 2 prolongs the column of air. The player further feels the breath heavy. This is because of the fact that the prior art rotary valve increases the resistance against the air-flow and an abrupt change in the acoustic impedance.

As described hereinbefore, the bypass tube 2 prolongs the column of air, and the tones are produced from the vibrations of the air column. When the player blows the mouthpiece, the breath causes the air to flow through the main tube 1. If the prior art rotary valve connects the bypass tube 2 to the main tube 1, the prior art rotary valve guides the air-flow from the main tube 1 to the bypass tube 2 and from the bypass tube 2 toward the bell 3. The ports 9 and 10 are directed at 90 degrees with respect to the other ports 7/8, and, accordingly, the air-flow is bent at 90 degrees twice. Thus, the prior art rotary valve increases the resistance against the air-flow. Although the main tube 1 and the bypass tube 2 are circular in cross section, the cross sections of the recesses 16/17 are widely deformed from the circular cross section (see FIG. 3). This results in the abrupt change of the acoustic impedance at the boundary between the main/bypass tubes 1/2 and the recesses 16/17. Thus, the problem is reasoned from the large resistance and the abrupt change of the acoustic impedance.

Another prior art rotary valve is disclosed in Japanese Patent Publication of Unexamined Application (laid-open) No. 62-67590. Japanese Patent Publication of Unexamined Application No. 62-67590 is corresponding to the specification for German Patent Application No. P3533400.2 filed on Sep. 19, 1985. The prior art rotary valve is used in a trumpet or a horn. An application to a trombone is not suggested in the Japanese Patent Publication of Unexamined Application.

The prior art rotary valve is shown in FIG. 4, and comprises a casing 21, a bearing unit 22, two valve bodies 23/24 and a connecting tube 25. The casing 21 is separated into two parts 26/27, and the two parts 26/27 are provided on both sides of the bearing unit 22. The part 26 has three ports 28/29/30, and the port 28 is directed at 90 degrees with respect to the other port 29. Similarly, the part 27 has three ports 31/32/33, and the port 31 is directed at 90 degrees with respect to the other port 32. The port 30 is connected through the connecting tube 25 to the port 33. The ports 28/31 are connected to two parts of a main tube (not shown), and a bypass tube (not shown) is connected at both ends to the ports 29/32.

The valve bodies 23/24 is shaped in a frustum of cone, and are respectively accommodated in the parts 26/27, respectively. The valve bodies are connected to each other, and are rotatably supported by the bearing unit 22. Air passages are formed in the valve bodies 23/24, and selectively connect the ports 28/31 to the ports 30/33 and the ports 29/32 depending upon the position in the casing 21.

When a player rotates the valve bodies 23/24, the prior art rotary valve connects the bypass tube to the main tube, or disconnects the bypass tube from the main tube.

The trumpet has three rotary valves for changing the pitch of the tone, and the horn also requires three rotary valves. A player selectively manipulates the three rotary valves by using the fingers of the right hand, and the three rotary valves are arranged closely. This results in the bypass tubes perpendicular to the main tube. For this reason, the ports 29/32 are directed at 90 degrees with respect to the ports 28/31.

Although the Japanese Patent Publication of Unexamined Application is silent to any application to the trombone, the problem would be also encountered in a trombone equipped with the prior art rotary valve shown in FIG. 4.

Yet another prior art rotary valve is disclosed in Japanese Patent Publication of Unexamined Application (laid-open) No. 2-211498. The Japanese Patent Publication of Unexamined Application is corresponding to the specification for U.S. Pat. Ser. No. 08/268,843 filed on Nov. 8, 1988. FIG. 5 illustrates the prior art rotary valve disclosed in Japanese Patent Publication of Unexamined Application No. 2-211498.

The prior art rotary valve comprises a casing 41, a rotary body 42 and a bottom plate 43. The casing 41 is shaped into a frustum of cone, and has an inner space also in the form of a frustum of cone. Two ports 44 and 45 are formed in the casing 41. The port 44 is open to the top surface of the frustum of cone, and a part 47 of a main tube is connected to the port 44. The other port 45 is open to a slant surface, and a bypass tube 48 is connected at one end thereof to the other port 45.

A shaft 49 is connected to the bottom surface of the rotary body 42. The rotary body has an axis of rotation aligned with the axis of the shaft 49. The rotary body 42 is also shaped into a frustum of cone, and the bottom plate 43 has a disk configuration. The rotary body 42 is rotatably received in the inner space of the casing 41, and the bottom plate 43 closes the inner space. The shaft 49 passes through a hole 50, which is formed in the center of the bottom plate 43. Though not shown in FIG. 5, a lever is fixed to the shaft 49, and a player manipulates the lever for changing the effective length of the air column. When the player drives the shaft for rotation, the rotary body 42 turns around the axis of rotation in the inner space defined in the casing 41, and changes an angular position thereof around the axis of rotation.

Two air passages 51 and 52 are formed in the rotary body 42. The air passage 51 is open at one end thereof in the top surface of the rotary body 42 and at the other end thereof in the bottom surface of the rotary body 42. The air passage is gently curved between the top surface and the bottom surface. The one end of the air passage 51 has a center aligned with the axis of rotation, and, accordingly, the air passage 51 is connected to through the port 44 to the part 47 of the main tube regardless of the angular position of the rotary body 42. However, the other end of the air passage 51 is offset from the axis of rotation, and the rotary body 42 changes the position of the other end of the air passage 51 with respect to the bottom plate depending upon the angular position.

The other air passage is open at one end thereof on the slant surface and at the other end thereof in the bottom surface, and is gently curved between the slant surface and the bottom surface. The port 45 and the one end of the air passage 52 are equally spaced from the bottom surfaces, and the other ends of the air passages 51/52 are equally spaced from the axis of rotation. The bottom plate 42 has two ports 53 and 54, which are connected to the other end of the bypass tube 48 and another part 55 of the main tube, respectively. The ports 53/54 are equally spaced from the center of the hole 50, and the distance between the axis and the air passages 51/52 on the bottom surface is equal to the distance between the center and the ports 53/54. For this reason, the air passages 51/52 are connected between the ports 44/45 and the ports 53/54 at the first angular position, and only the air passage 51 is connected between the port 44 and the port 54 at the second angular position.

When the rotary body 42 is in the first angular position, the bypass tube 48 is connected between the part 47 of the main tube and the other part 55 of the main tube. If the rotary body 42 is changed from the first angular position to the second angular position, the part 47 of the main tube is directly connected to the other part 55 of the main tube.

The ports 44/45 and 53/54 are circular openings, and the air passages 51/52 have a circular cross section. A center-line, which passes through the other end of the air passage 51, crosses the axis of rotation at an acute angle. The other air passage 52 also has center-lines at both ends thereof, which respectively cross the axis of rotation at acute angles. This results in reduction of the resistance against the air-flow and acoustic impedance varied more gently than the acoustic impedance of the other prior art rotary valves. Thus, a trombone equipped with the prior art rotary shown in FIG. 5 achieves stability in the tone color and the pitch as well as comfortable breathing. However, another problem is encountered in the trombone equipped with the prior art rotary valve shown in FIG. 5 in the manipulability of the prior art rotary valve. As described hereinbefore, the player puts the trombone on the left shoulder, and pushes the mouthpiece to the lips. The player grips the bars 4*a* and 5*a* (see FIG. 1) with the left hand and the right band, and blows into the mouthpiece. When the player wishes to prolong the column of air, he manipulates the rotary valve with a finger of the left hand. This means that the lever of the prior art rotary valve is close to the neck or the jaw. The prior art rotary valve shown in FIG. 5 occupies wide space, and the lever is located in the close proximity to the jaw. As a result, the player feels the prior art rotary valve not easy to manipulate.

SUMMARY OF THE INVENTION

It is therefore an important object of the present invention to provide a trombone, which has a valve easy to manipulate.

It is also an important object of the present invention to provide the valve appropriate to the trombone.

The present inventor contemplated the problem inherent in the prior art rotary valve, and noticed that the air passages 51/52 were open to the bottom surface perpendicular to the axis of the main tube 47/55. Both of the bypass tube 48 and the main tube 55 were connected to the bottom plate 43, and were parallel to one another. This resulted in the bottom plate 43 wide enough to be connected to both of the bypass tube 48 and the main tube 55. The wide bottom plate 43 made the prior art rotary valve large, and the prior art rotary valve occupied the wide space. The present inventor concluded that at least one of the bypass/main tubes had to be connected to both ends of a casing.

In accordance with one aspect of the present invention, there is provided a trombone comprising a mouthpiece blown by a player, a bell flared from one end thereof toward the other end, a main tube defining a column of air and having a first sub-tube connected at one end thereof to the mouthpiece and a second tube connected at one end thereof to the aforesaid one end of the bell, a valve unit including a casing defined by end surfaces spaced from one another and a side surface extending between the end surfaces and having a first port formed in one of the end surfaces and connected to the other end of the first sub-tube, a second port formed in the other of the end surfaces and connected to the other end of the second sub-tube, a pair of third ports formed in a first area in the side surface and a pair of fourth ports formed in a second area in the side surface, a guide member having a first air passage connected at both ends thereof to the third ports of the pair, a rotor rotatably accommodated in the casing and having a second air passage connected between the first port and one of the third ports at a first angular position and between the first port and one of the fourth ports at a second angular position, a third air passage connected between the other of the third ports and the second port at the first angular position and between the other of the fourth ports and the second port at the second angular position and a manipulator manipulated by the player so as to drive the rotor for rotation and a bypass tube connected at both ends thereof to the fourth ports of the pair.

In accordance with another aspect of the present invention, there is provided a valve unit comprising a casing defined by end surfaces spaced from one another and a side surface extending between the end surfaces and having a first port formed in one of the end surfaces, a second port formed in the other of the end surfaces, a pair of third ports formed in a first area of the side surface and a pair of fourth ports formed in a second area of the side surface, a guide member having a first air passage connected at both ends thereof to the third ports of the pair, a rotor rotatably accommodated in the casing and having a second air passage connected between the first port and one of the third ports at a first angular position and between the first port and one of the fourth ports at a second angular position and a third air passage connected between the other of the third ports and the second port at the first angular position and between the other of the fourth ports and the second port at the second angular position, and a manipulator manipulated by the player so as to drive the rotor for rotation.

BRIEF DESCRIPTION OF THE DRAWINGS

The features and advantages of the trombone and the valve will be more clearly understood from the following description taken in conjunction with the accompanying drawings in which.

DESCRIPTION OF THE PREFERRED EMBODIMENT

Figure 1:
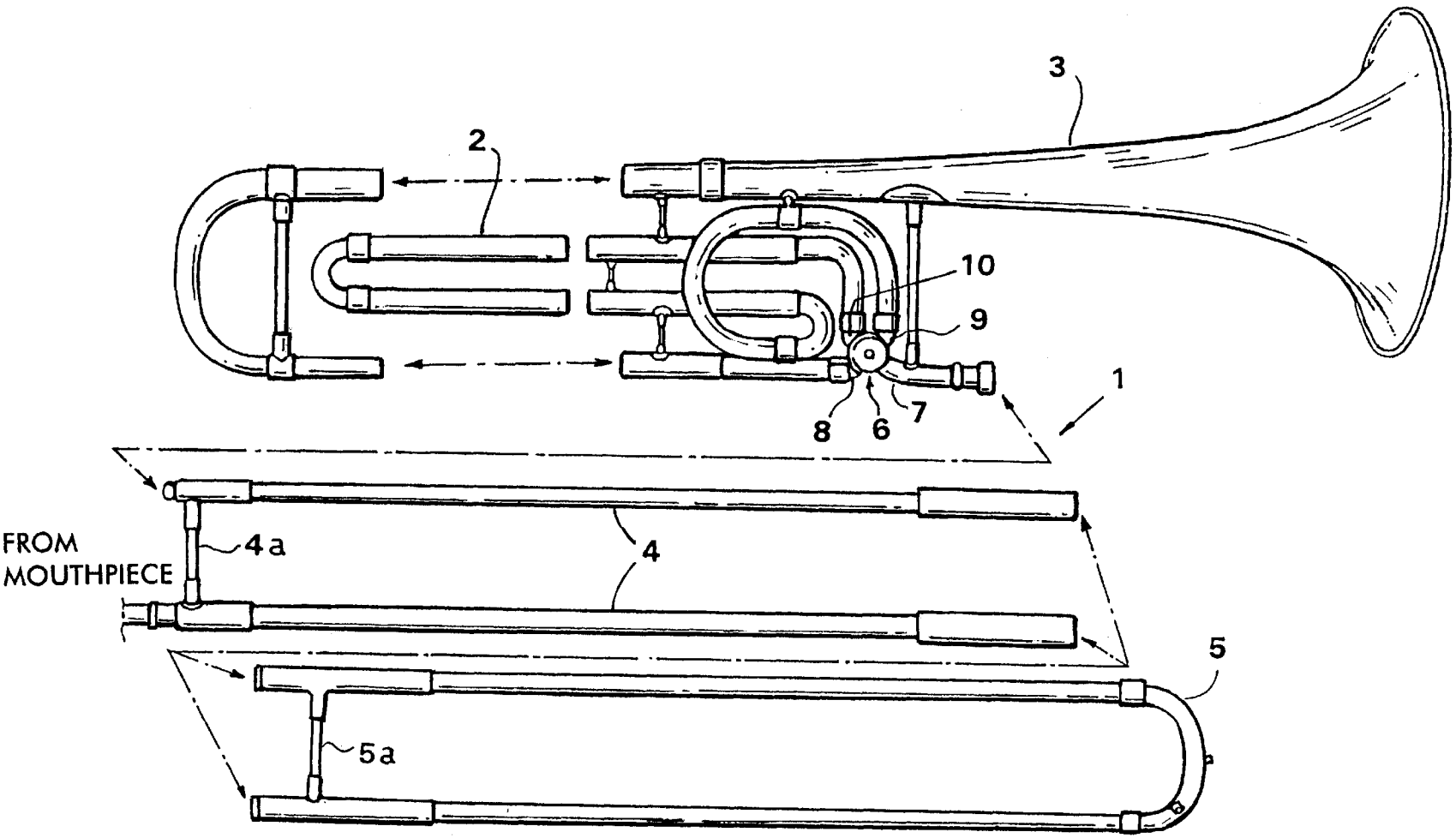
FIG. 1 PRIOR ART
FIG. 1 is a fragmentary front view showing the prior art trombone.
Figure 2:
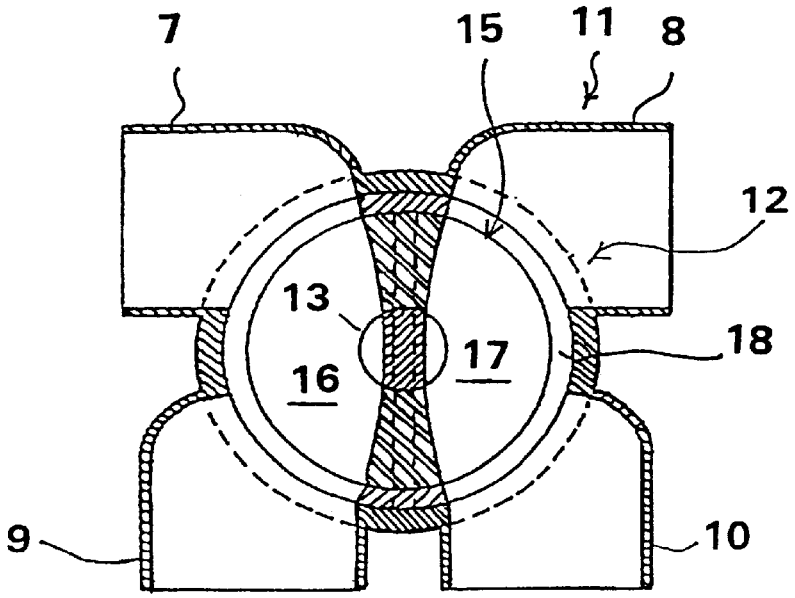
FIG. 2 PRIOR ART
FIG. 2 is a cross sectional view showing the cross section of the valve incorporated in the prior art trombone.
Figure 3:
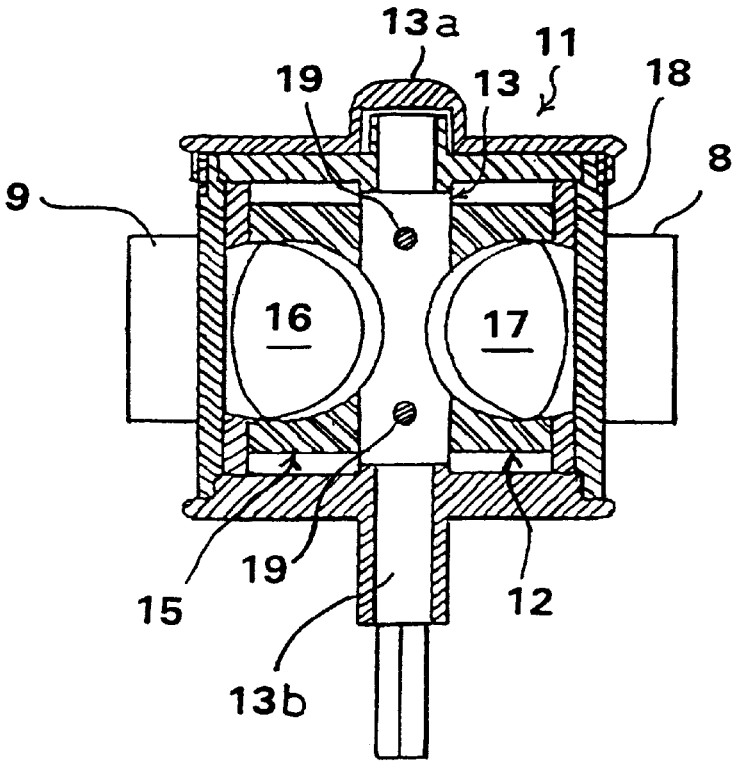
FIG. 3 PRIOR ART
FIG. 3 is a cross sectional view showing another cross section of the valve.
Figure 4:
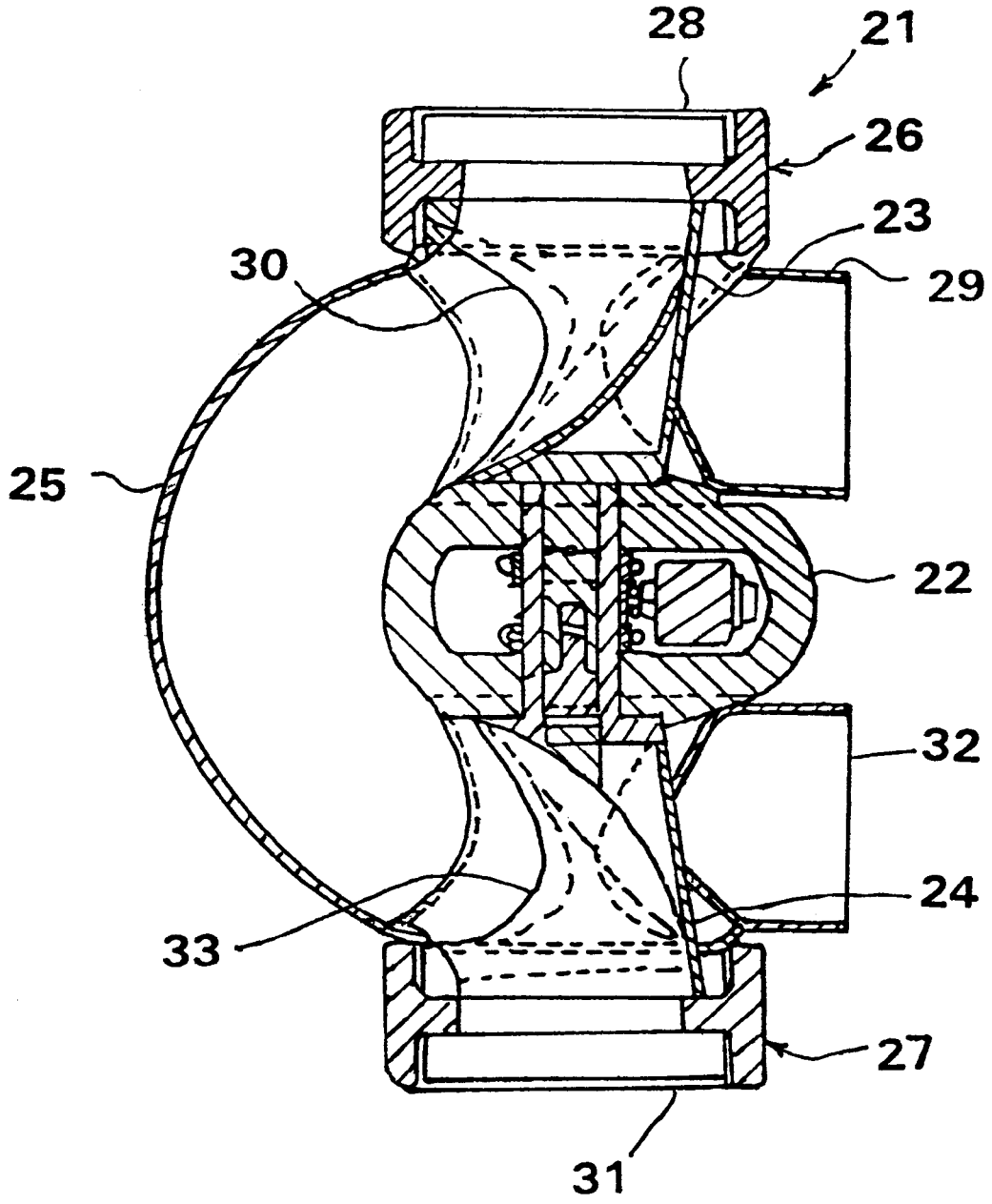
FIG. 4 PRIOR ART
FIG. 4 is a cross sectional view showing another prior art rotary valve.
Figure 5:
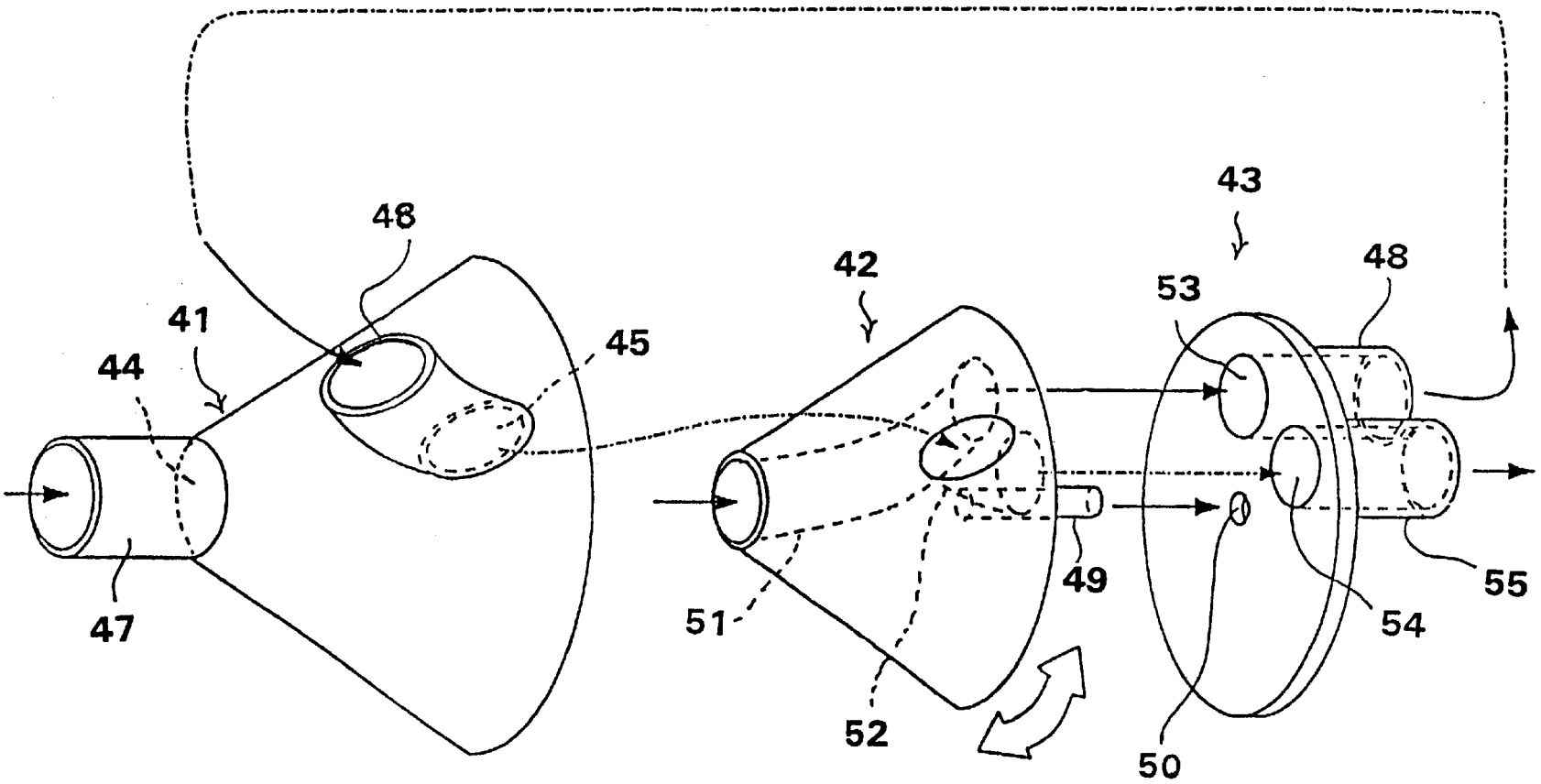
FIG. 5 PRIOR ART
FIG. 5 is a fragmentary perspective view showing yet another prior art rotary valve.
Figure 6:
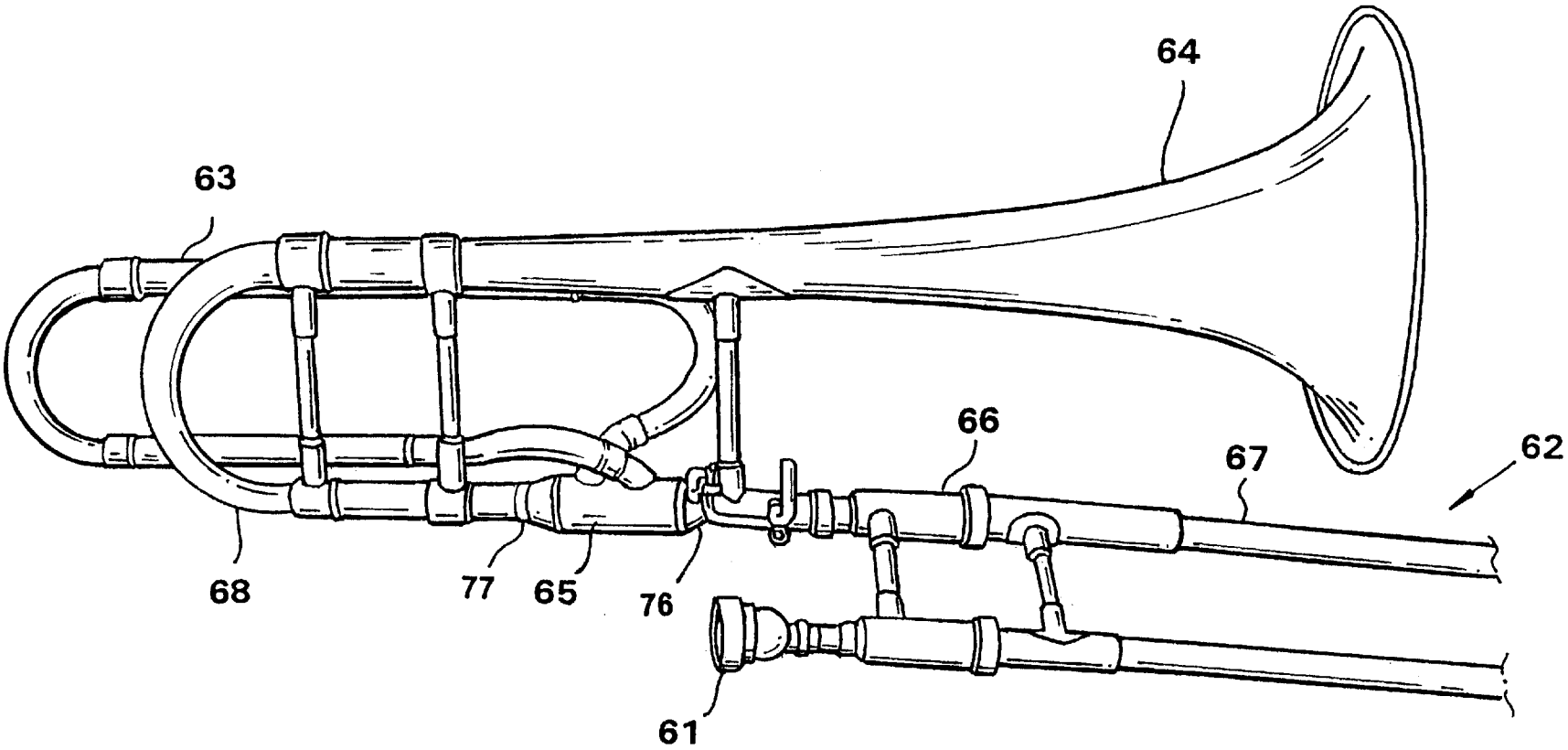
FIG. 6 is a perspective view showing a trombone according to the present invention.

Referring to FIG. 6 of the drawings, a trombone embodying the present invention comprises a mouthpiece 61, a main tube 62, a bypass tube 63, a bell 64 and a rotary valve unit 65. The main tube 62 includes an inner tube 66, an outer tube 67 and a curved tube 68. The two pipe members and a grip bar form in combination the inner tube 66, and the mouthpiece 61 is attached to one of the pipe members. The outer tube 67 has a U-letter shaped pipe member and a grip bar fixed at both ends thereof to the U-letter shaped pipe member, and the two pipe members are inserted into the U-letter shaped pipe member. Thus, the outer tube 67 is slidable on the inner tube 66. The rotary valve unit 65 is connected to the other of the pipe members, and the curved tube 68 is connected at both ends thereof to the rotary valve unit 65 and the bell 64. The bypass tube 63 is further connected to the rotary valve unit 65. The rotary valve unit 65 directly connects the inner tube 66 to the curved tube 68 at the first angular position, and connects the inner tube 66 through the bypass tube 63 to the curved tube 68 at the second angular position. The bypass tube 63 prolongs the column of air defined in the main tube 62.

Figure 7:
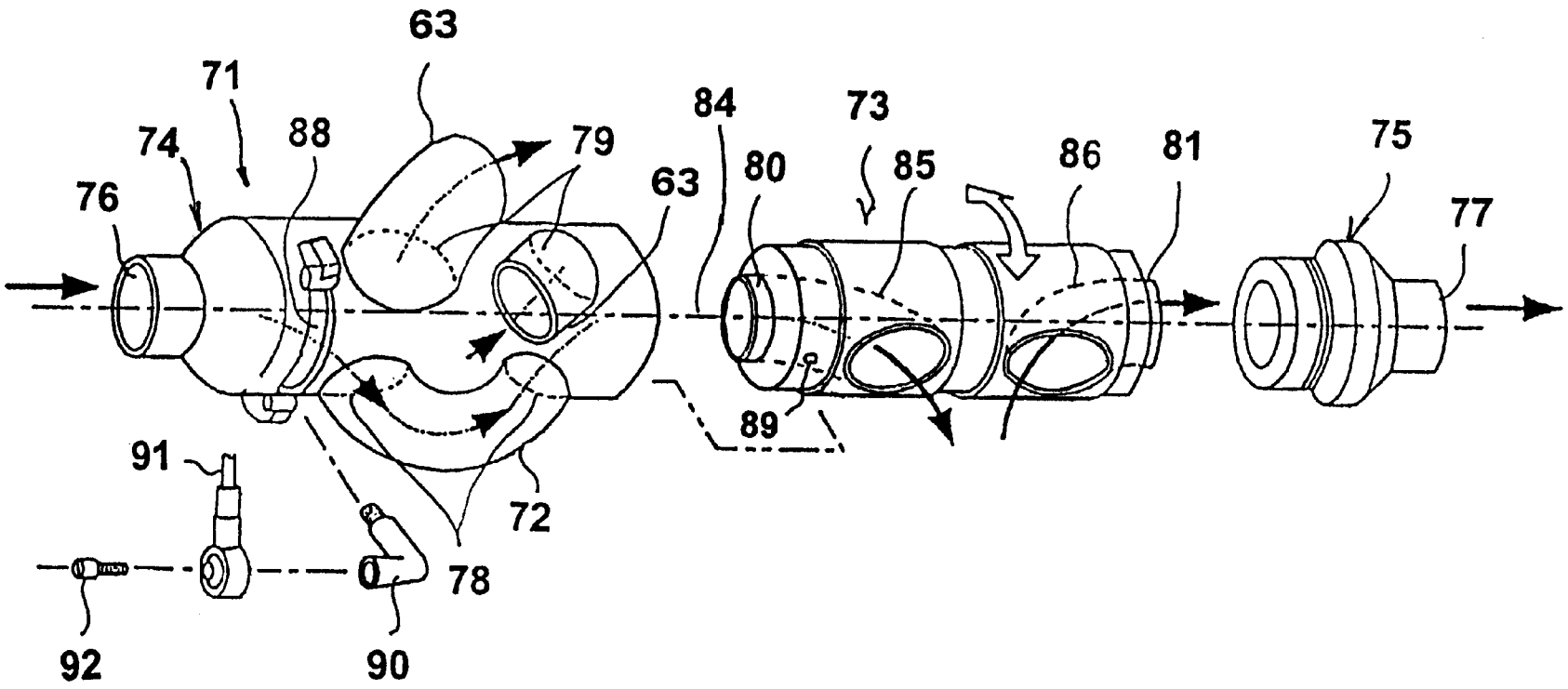
FIG. 7 is a fragmentary perspective view showing a rotary valve incorporated in the trombone.
Figure 8:
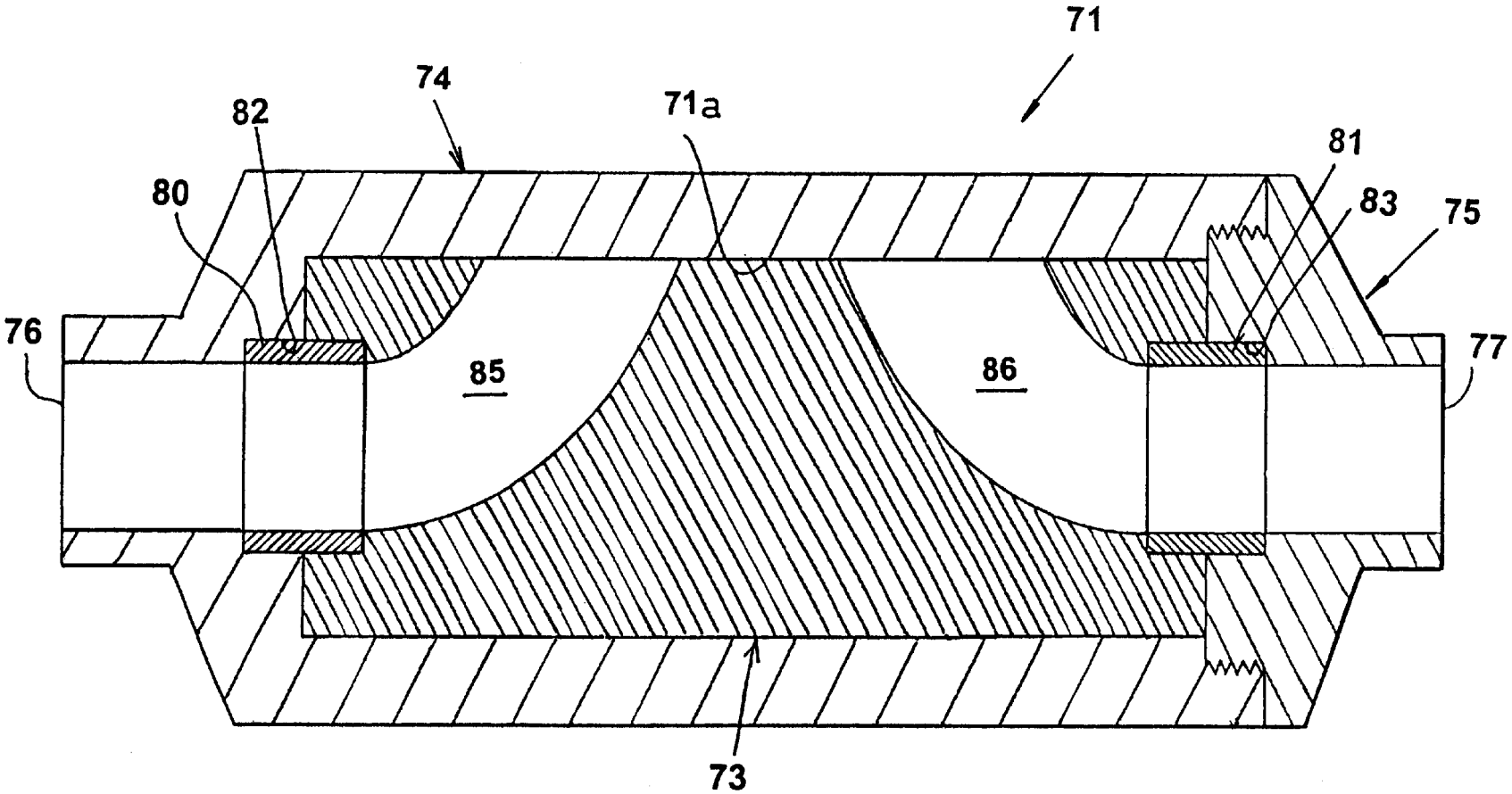
FIG. 8 is a cross sectional view showing the structure of the rotary valve.

The rotary valve unit 65 is shown in FIGS. 7 and 8 in detail. The rotary valve unit 65 is broken down into a cylindrical casing 71, a guide tube 72 and a rotor 73. In this instance, the cylindrical casing 71 is split into a column-shaped cylinder block 74 and a cylinder head 75. The cylinder head 75 is screwed into the column-shaped cylinder block 74, and the column-shaped cylinder block 74 and the cylinder head 75 defines a cylindrical inner space 71*a* therein. The cylinder head 75 is easily assembled with and disassembled from the column-shaped cylinder block 74. The column-shaped cylinder block 74 gives large mechanical strength to the rotary valve unit according to the present invention.

A first port 76 is formed in one end surface of the cylindrical casing 71, and a second port 77 is formed in the other end surface of the cylindrical casing 71. The first port 76 and the second port 77 project in the directions opposite to each other, and have center axes, which are coincident with a center axis of the cylindrical inner space. A pair of third ports 78 and a pair of fourth ports 79 are formed on the side surface of the cylindrical casing 71.

The third ports 78 are differently spaced from the first port 76, and a virtual line drawn between the centers of the third ports 78 extends in parallel to the center axis of the cylindrical inner space. The fourth ports 79 are differently spaced from the first port 76, and a virtual line drawn between the centers of the fourth ports 79 extends in parallel to the center axis of the cylindrical inner space. Although one of the third ports 78 and one of the fourth ports 79 are equally spaced from the first port 76 in the direction of the center axis of the cylindrical casing 71, they are angularly spaced from one another around the center axis. Similarly, the other of the third ports 78 and the other of the fourth ports 79 are equally spaced from the second port 77, and are angularly spaced from one another around the center axis. The guide tube 72 is gently curved, and is connected between the third ports 78. On the other hand, the bypass tube 63 is much longer than the guide tube 72, and is connected between the fourth ports 79.

The rotor 73 has a generally cylindrical configuration, and short straight tubes 80 and 81 projects in the directions opposite to each other, respectively. The short straight tubes 80/81 have respective center axes, which are coincident with the center axis of the rotor 73. The short straight tubes 80/81 are received in recesses 82/83 formed inside the cylindrical casing 71, and allows the rotor 73 to smoothly rotate around an axis of rotation 84. The outer surface of the short straight tubes 80/81 and the inner surfaces of the cylindrical casing 71 are well finished, and the gap therebetween is of the order of tens microns. The breath is not leaked through the gap between the short straight tubes 80/81 and the recesses 82/83, because the short straight tubes 80/81 and the cylindrical casing 71 are in face-to-face contact. The axis of rotation 84 is coincident with the center axis of the cylindrical casing 71. Thus, the rotor 73 is rotatable around the axis of rotation or the center axis of the cylindrical casing 71. The short straight tubes 80/81 are connected to the first port 76 and the second port 77 at all times regardless of the angular position of the rotor 73 around the axis of rotation 84.

Two air passages 85/86 are formed in the rotor 73. The rotor 73 is long enough to gently curve the air passages 85/86. Even though the rotor 73 is long, the rotary valve unit according to the present invention is thinner than the prior art rotary valve unit, because only the outlet port 77 is formed in the end surface. This results in the compact rotary valve unit. The air passage 85 is formed in one half portion of the rotor 73, and the other air passage 86 is formed in the other half portion of the rotor 73. The air passage 85 has one end connected to the short straight tube 80 and the other end open to the side surface of the half portion. Similarly, the air passage 86 has one end connected to the other short straight tube 81 and the other end open to the side surface of the half portion. A virtual line drawn between the centers of the other ends is in parallel to the rotational axis. When virtual tangential lines are drawn, the virtual tangential lines are in contact with the air passages 85/86, respectively, and angles between the axis of rotation 84 and the virtual tangential lines are less than 90 degrees at any contact points along the air passages 85/86. Thus, the air passages 85/86 are gently curved, and the resistance against the air-flow is small.

The first port 76, the second port 77, the third ports 78 and the fourth ports 79 have respective circular openings, which are equal in diameter. The air passage in the guide tube 72 and the air passages 85/86 have circular cross sections, which are also equal in diameter. For this reason, the rotary valve unit according to the present invention is small in resistance against the air-flow, and the acoustic impedance is never abruptly varied.

A slot 88 is formed in the cylindrical casing 71, and a threaded hole 89 is formed in the rotor 73. A nipple 90 is screwed into the threaded hole 89 through the slot 88, and a manipulating lever 91 is fixed to the nipple 90 by means of a bolt 92.

Though not shown in the drawings, a spring urges the lever 91 so as to keep the rotor 73 in a first angular position. When a player presses the lever 91 against the elastic force of the spring, the rotor 73 is driven for rotation around the axis 84, and is changed from the first angular position to a second angular position. However, if the player removes the force from the lever, the rotor 73 returns to the first angular position.

Figure 9:
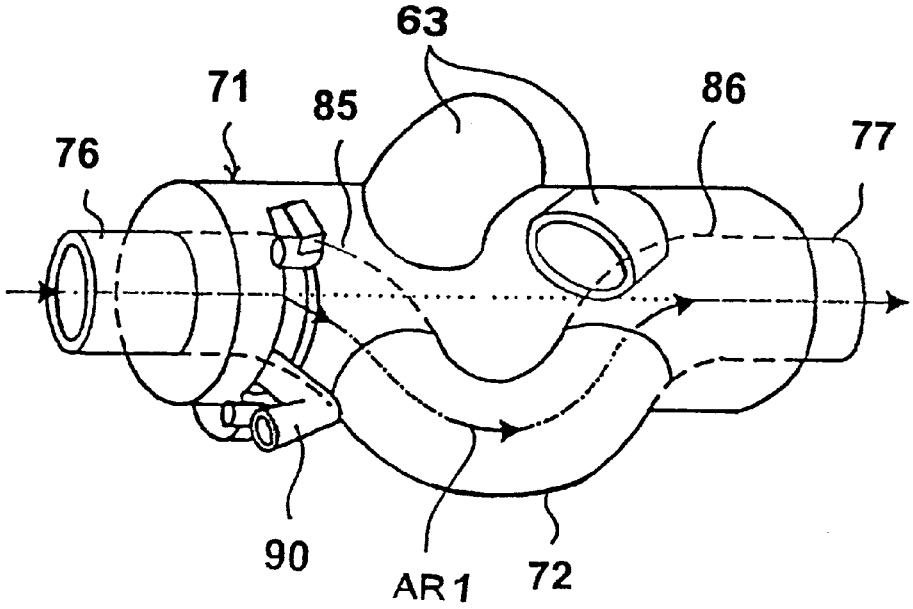
FIG. 9 is a perspective view showing the rotary valve at the first angular position.
Figure 10:
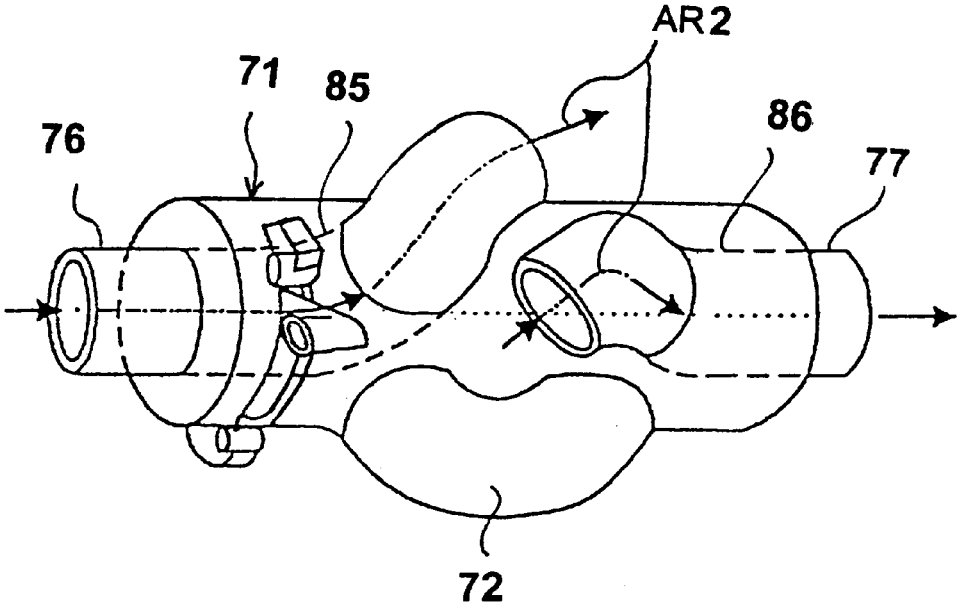
FIG. 10 is a perspective view showing the rotary valve at the second angular position.

The air passages 85 and 86 are connected between the first port 76 and one of the third ports 78 and between the other third port 78 and the second port 77 in the first angular position, and are connected between the first port 76 and one of the fourth ports 79 and between the other fourth port 79 and the second port 77 in the second angular position. The rotor 73 in the first angular position is shown in FIG. 9, and the air-flow is indicated by arrows AR1. On the other hand, the rotor 73 in the second angular position is shown in FIG. 10, and the air-flow is indicated by arrows AR2.

As will be appreciated from the foregoing description, only the main tube 62 is connected to the first port 76 and the second port 77 at both ends of the cylindrical casing 71, and the guide tube 72 and the bypass tube 63 are connected to the peripheral surface of the cylindrical casing 71. This results in the generally cylindrical configuration and, accordingly, the compact rotary valve unit. The compact rotary valve unit improves the manipulability of the trombone.

Although particular embodiments of the present invention have been shown and described, it will be apparent to those skilled in the art that various changes and modifications may be made without departing from the spirit and scope of the present invention.

For example, the virtual lines drawn between the third ports 78 and between the fourth ports may be twisted with respect to the axis of rotation. In this instance, the air passages 85 and 86 are arranged in such a manner that the virtual line between the openings extends in parallel to the virtual lines. The smoother the air passages, the smaller the resistance. The positions of the ports 76/77/78/79 may be optimized in accordance with this principle.

What is claimed is:

1. A trombone comprising a mouthpiece blown by a player, a bell flared from one end thereof toward the other end, a main tube defining a column of air and having a first sub-tube connected at one end thereof to said mouthpiece and a second sub-tube connected at one end thereof to said one end of said bell, a valve unit including a casing defined by end surfaces spaced from one another and a side surface extending between said end surfaces and having a first port formed in one of said end surfaces and connected to the other end of said first sub-tube, a second port formed in the other of said end surfaces and connected to the other end of said second sub-tube, a pair of third ports formed in a first area in said side surface and a pair of fourth ports formed in a second area in said side surface, a guide member having a first air passage connected at both ends thereof to said third ports of said pair, a rotor rotatably accommodated in said casing and having a second air passage connected between said first port and one of said third ports at a first angular position and between said first port and one of said fourth ports at a second angular position, a third air passage connected between the other of said third ports and said second port at said first angular position and between the other of said fourth ports and said second port at said second angular position and an axis of rotation, said second air passage being spaced from said third air passage in a direction of said axis of rotation, a manipulator manipulated by said player so as to drive said rotor for rotation, and a bypass tube connected at both ends thereof to said fourth ports of said pair, wherein virtual tangential lines are respectively in contact with said second air passage and said third air passage, and angles between said axis of rotation and said virtual tangential lines are less than 90 degrees at any contact points along said second air passage and said third air passage.

2. The trombone as set forth in claim 1, in which said rotor and said casing have a generally columnar configuration and a cylindrical configuration, respectively.

3. The trombone as set forth in claim 1, in which said second air passage and said third air passage respectively have center axes, and said center axes are aligned with an axis of said guide member at said third ports and with an axis of said bypass tube at said fourth ports.

4. The trombone as set forth in claim 3, in which said second air passage and said third air passage have circular cross sections, and said first air passage, said first port, said second port, said third ports, said fourth ports, said main tube and said guide tube have circular cross sections, respectively.

5. The trombone as set forth in claim 1, in which said second air passage and said third air passage have circular cross sections, and said first air passage, and first port, said second port, said third ports, said fourth ports, said main tube and said guide tube have circular cross sections, respectively.

6. The trombone as set forth in claim 1, in which said manipulator includes a slot formed in said casing and extending around an axis of rotation of said rotor, and a manipulating member passing through said slot and connected to said rotor.

7. A trombone comprising a mouthpiece blown by a player, a bell flared from one end thereof toward the other end, main tube defining a column of air and having a first sub-tube connected at one end thereof to said mouthpiece and a second tube connected at one end thereof to said one end of said bell, a valve unit including a casing defined by end surfaces spaced from one another and a side surface extending between said end surfaces and having a first port formed in one of said end surfaces and connected to the other end of said first sub-tube, a second port formed in the other of said end surfaces and connected to the other end of said second sub-tube, a pair of third ports formed in a first area in said side surface and a pair of fourth ports formed in a second area in said side surface, a guide member having a first air passage connected at both ends thereof to said third ports of said pair, a rotor rotatably accommodated in said casing and having a second air passage connected between said first port and one of said third ports at a first angular position and between said first port and one of said fourth ports at a second angular position, a third air passage connected between the other of said third ports and said second port at said first angular position and between the other of said fourth ports and said second port at said second angular position, a manipulator manipulated by said player so as to drive said rotor for rotation, and a bypass tube connected at both ends thereof to said fourth ports of said pair, in which said rotor has an axis of rotation, and said second air passage is spaced from said third air passage in a direction of said axis of rotation.

8. A valve unit comprising a casing defined by end surfaces spaced from one another and a side surface extending between said end surfaces and having a first port formed in one of said end surfaces, a second port formed in the other of said end surfaces, a pair of third ports formed in a first area of said side surface and a pair of fourth ports formed in a second area of said side surface, a guide member having a first air passage connected at both ends thereof to said third ports of said pair, a rotor rotatably accommodated in said casing and having a second air passage connected between said first port and one of said third ports at a first angular position and between said first port and one of said fourth ports at a second angular position, a third air passage connected between the other of said third ports and said second port at said first angular position and between the other of said fourth ports and said second port at said second angular position and an axis of rotation, said second air passage being spaced from said third air passage in a direction of said axis of rotation, a manipulator manipulated by said player so as to drive said rotor for rotation in which virtual tangential lines are respectively in contact with said second air passage and said third air passage, and angles between said axis of said rotor and said virtual tangential lines are less than 90 degrees at any contact points along said second air passage and said third air passage.

9. The valve as set forth in claim 8, in which said rotor and said casing have a generally columnar configuration and a cylindrical configuration, respectively.

10. The valve as set forth in claim 8, in which said rotor has an axis of rotation, and said second air passage is spaced from said third air passage in a direction of said axis of rotation.

11. The valve as set forth in claim 8, in which said second air passage, and said third air passage have center axes, respectively, and said center axes are aligned with a center axis of said guide member at said third ports.

12. The valve as set forth in claim 8, in which said second air passage and said third air passage have circular cross sections, and said first air passage, said first port, said second port, said third ports, said fourth ports, said main tube and said guide tube have circular cross sections, respectively.

13. A valve unit comprising a casing defined by end surfaces spaced from one another and a side surface extending between said end surfaces and having a first port formed in one of said end surfaces, a second port formed in the other of said end surfaces, a pair of third ports formed in a first area of said side surface and a pair of fourth ports formed in a second area of said side surface, a guide member having a first air passage connected at both ends thereof to said third ports of said pair, a rotor rotatably accommodated in said casing and having a second air passage connected between said first port and one of said third ports at a first angular position and between said first port and one of said fourth ports at a second angular position, a third air passage connected between the other of said third ports and said second port at said first angular position and between the other of said fourth ports and said second port at said second angular position, and a manipulator manipulated by said player so as to drive said rotor for rotation in which said rotor has a body formed with said second air passage and said third air passage, a first short straight tube smaller in diameter than said body, connected to said second air passage and rotatably supported by said casing and a second short straight tube smaller in diameter than said body, connected to said third air passage and rotatably supported by said casing.

* * * * *